US006807975B1

(12) United States Patent
Muller, Jr.

(10) Patent No.: US 6,807,975 B1
(45) Date of Patent: Oct. 26, 2004

(54) URINE BAG CLEANING MACHINE

(76) Inventor: Byron K. Muller, Jr., 635 S. Almond St., Dixon, CA (US) 95620

( * ) Notice: Subject to any disclaimer, the term of this patent is extended or adjusted under 35 U.S.C. 154(b) by 319 days.

(21) Appl. No.: 10/076,587

(22) Filed: Feb. 15, 2002

(51) Int. Cl.[7] ..... B08B 9/08

(52) U.S. Cl. ..... 134/169 C; 134/166 C; 134/168 C; 134/111

(58) Field of Search ..... 604/332, 334, 604/277; 134/166 R, 168 C, 166 C, 169 C, 169 R, 111

(56) References Cited

U.S. PATENT DOCUMENTS 1,195,542 A * 8/1916 Raymond ..... 403/87
2,788,008 A * 4/1957 Wanzer ..... 134/103.1
3,039,477 A * 6/1962 Harbo ..... 134/169 C
3,070,104 A * 12/1962 Faust et al. ..... 134/145
3,319,638 A * 5/1967 Ellison ..... 134/107
3,620,234 A * 11/1971 Everroad ..... 134/86
3,893,843 A * 7/1975 Fry et al. ..... 134/10
4,354,514 A * 10/1982 Sundheimer et al. ..... 134/152
4,379,467 A * 4/1983 Purr ..... 134/111
4,651,762 A * 3/1987 Bowden ..... 134/111
4,763,678 A 8/1988 Ott
4,766,622 A 8/1988 Pacelli
4,995,410 A 2/1991 Lash
5,503,633 A 4/1996 Saunders et al.
5,533,539 A * 7/1996 Sutter et al. ..... 134/95.2
5,549,759 A * 8/1996 Lithander ..... 134/22.11
5,554,228 A * 9/1996 Giordano et al. ..... 134/21
5,582,651 A * 12/1996 Schnaars ..... 134/6
5,709,236 A * 1/1998 Rodriguez ..... 134/167 R
5,753,195 A * 5/1998 Langford et al. ..... 422/292
5,819,770 A * 10/1998 Randall et al. ..... 134/57 R
5,921,256 A * 7/1999 Barin ..... 134/22.12
6,068,817 A 5/2000 Addy et al.
6,103,189 A 8/2000 Kralovic
6,363,952 B1 * 4/2002 Baioff et al. ..... 134/111
6,408,861 B1 * 6/2002 Ortega ..... 134/100.1
6,523,556 B2 * 2/2003 Abad et al. ..... 134/166 C

* cited by examiner

*Primary Examiner*—Frankie L. Stinson

(57) ABSTRACT

A urine bag cleaning machine includes a housing that has an interior space. A pump is positioned in the interior space. A tank is positioned in the interior space. A conduit is positioned in the interior space and is environmentally coupled to the pump and the tank. A filter system is operationally coupled to the conduit for filtering a fluid for passing through the conduit. An influent manifold is positioned in the interior space and environmentally coupled to the pump. An exfluent manifold is positioned in the interior space and is environmentally coupled to the tank. The influent manifold and the exfluent manifold is substantially aligned apertures whereby the influent and exfluent manifolds are adapted for coupling to opposite ends of a urine bag to form a closed system for passing the fluid through the urine bag whereby the urine bag is cleansed.

11 Claims, 1 Drawing Sheet

URINE BAG CLEANING MACHINE

BACKGROUND OF THE INVENTION

1. Field of the Invention

The present invention relates to urine bag cleaning apparatuses and more particularly pertains to a new urine bag cleaning machine for cleaning and sanitizing urine collection bags.

2. Description of the Prior Art

The use of urine bag cleaning apparatuses is known in the prior art. U.S. Pat. No. 5,503,633 describes an astomy bag cleaning apparatus for the cleaning of an ostomy bag worm by and astomy patient. Another type of urine bag cleaning apparatus is U.S. Pat. No. 4,995,410 having an astomy cleaning and receptacle replacement station for storing, cleaning and replacing astomy equipment. U.S. Pat. No. 4,766,622 describes a peritoneal waste discharge system including a disinfectant storage chamber. U.S. Pat. No. 4,763,678 describes a cleaning apparatus for elongated enclosed channel devices. U.S. Pat. No. 6,103,189 describes a method of removing microbial contamination. U.S. Pat. No. 6,068,817 describes a method for sterilizing an interior of an article with a diffusion-restricted area.

While these devices fulfill their respective, particular objectives and requirements, the need remains for a device that is superior in it's cleaning ability.

SUMMARY OF THE INVENTION

The present invention meets the needs presented above by utilizing a 140-horsepower motor and 5000 CMF pump and dual filtration to provide a fast and effective cleaning process.

Still yet another object of the present invention is to provide a new urine bag cleaning machine that would be portable and easy to use. The cleaning process would utilize conventional laundry detergent.

Even still another object of the present invention is to provide a new urine bag cleaning machine that would save the user money by effectively cleaning and sanitizing the bags including disposable and reusable versions.

To this end, the present invention generally comprises a housing that has an interior space. A pump is positioned in the interior space. A tank is positioned in the interior space. A conduit is positioned in the interior space and is environmentally coupled to the pump and the tank. A filter system is operationally coupled to the water tank for filtering a fluid for passing through the conduit. An influent manifold is positioned in the interior space and environmentally coupled to the pump. An exfluent manifold is positioned in the interior space and is environmentally coupled to the tank. The influent manifold and the exfluent manifold is substantially aligned apertures whereby the influent and exfluent manifolds are adapted for coupling to opposite ends of a urine bag to form a closed system for passing the fluid through the urine bag whereby the urine bag is cleansed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
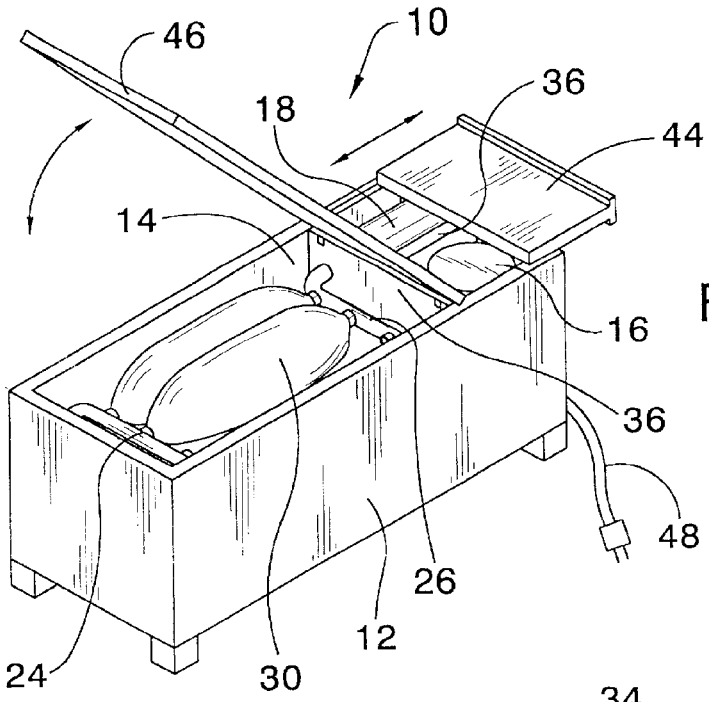
FIG. 1 is a perspective view of a new urine bag cleaning machine according to the present invention.
Figure 2:
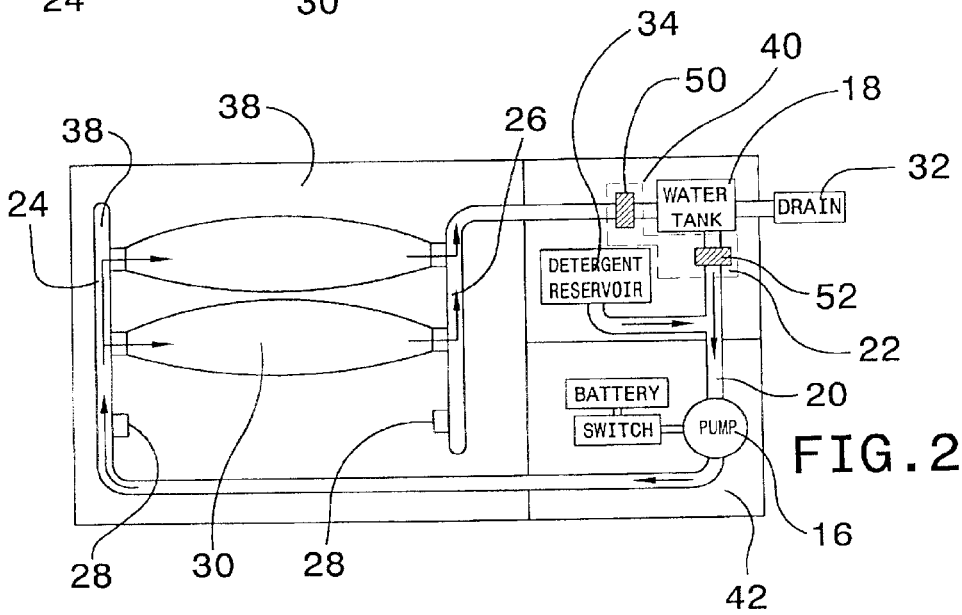
FIG. 2 is a block diagram view of the present invention.

With reference now to the drawings, and in particular to FIGS. 1 through 2 thereof, a new urine bag cleaning machine embodying the principles and concepts of the present invention and generally designated by the reference numeral 10 will be described.

As best illustrated in FIGS. 1 through 2, the urine bag cleaning machine 10 generally comprises a housing 12 that has an interior space 14. A pump 16 is positioned in the interior space 14. A tank 18 is positioned in the interior space 14. A conduit 20 is positioned in the interior space 14 and is environmentally coupled to the pump 16 and the tank 18. A filter system 22 is operationally coupled to the conduit 20 for filtering a fluid for passing through the conduit 20. An influent manifold 24 is positioned in the interior space 14 and environmentally coupled to the pump 16. An exfluent manifold 26 is positioned in the interior space 14 and is environmentally coupled to the tank 18. The influent manifold 24 and the exfluent manifold 26 is substantially aligned apertures 28 whereby the influent 24 and exfluent 26 manifolds are adapted for coupling to opposite ends of a urine bag 30 to form a closed system for passing the fluid through the urine bag 30 whereby the urine bag 30 is cleansed.

A drain 32 is operationally coupled to the tank 18 for permitting draining of the tank 18 when desired. A detergent reservoir 34 is environmentally coupled to the conduit 20 for introducing mixing a cleanser with the fluid to facilitate cleansing and deodorizing of the urine bag 30. The housing 12 has interior walls 36 that divide the interior space 14 into a manifold chamber 38, a tank chamber 40, and a pump chamber 42. The pump 16 is positioned in the pump chamber 42. The tank 18 is positioned in the tank chamber 40 and the influent 24 and exfluent 26 manifolds are substantially positioned in the manifold chamber 38. A cover member 44 is slidingly engaged to the housing 12 for selectively covering the pump chamber 42 and the tank chamber 40.

A lid 46 is pivotally coupled to the housing 12 for selectively covering the manifold chamber 38. The influent manifold 24 and the exfluent manifold 26 each has three selectively openable apertures 28 for permitting cleansing of up to three urine bags 30 simultaneously. An electrical cord 48 is operationally coupled to the pump 16 whereby the pump 16 is adapted for electrical connection to an electrical outlet to power the pump 16. The filtering system 22 includes a first filter 50 and a second filter 52 in series for filtering the fluid passing through the filtering system 22.

The filtering system 22 includes a first filter 50 and a second filter 52. The first filter 50 is coupled to the exfluent manifold 26 for filtering the fluid before it passes into the water tank 18. The second filter 52 is coupled to the conduit

20 for filtering the fluid before it passes into the pump 16. The second filter 52 is positioned between the water tank 18 and the detergent reservoir 34 for filtering the fluid before the cleanser is mixed into the fluid.

In use, the bag would be positioned within the unit, connecting to the water tubes at each bag's drain valve and adaptor valve. The machine would be appropriately sized to hold and clean two to three bags at one time.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A urine bag cleaning apparatus comprising:

a housing having an interior space;

a pump positioned in said interior space;

a tank positioned in said interior space;

a conduit positioned in said interior space and environmentally coupling said pump and said tank;

a filter system operationally coupled to said tank for filtering a fluid passed through said tank;

an influent manifold positioned in said interior space and environmentally coupled to said pump;

an exfluent manifold positioned in said interior space and environmentally coupled to said tank;

said influent manifold and said exfluent manifold having substantially aligned apertures whereby said influent and exfluent manifolds are adapted for coupling to opposite ends of a urine bag to form a closed system for passing the fluid through the urine bag whereby the urine bag is cleansed; and said apertures of said influent manifold being aligned with said apertures of said exfluent manifold to allow the urine bag to be in fluid communication with one of said apertures of said influent manifold and an associated one of said apertures of said exfluent manifold when the urine bag is coupled to said influent manifold and said exfluent manifold, each of said apertures of said influent manifold being in direct fluid communication with the associated one of said apertures of said exfluent manifold to allow the fluid to pass directly from said influent manifold to said exfluent manifold through the urine bag when the urine bag is coupled to the influent manifold and the exfluent manifold.

2. The urine bag cleaning apparatus of claim 1, further comprising:

a drain operationally coupled to said tank for permitting draining of said tank when desired.

3. The urine bag cleaning apparatus of claim 1, further comprising:

a detergent reservoir environmentally coupled to said conduit for introducing for mixing a cleanser with the fluid to facilitate cleansing and deodorizing of the urine bag.

4. The urine bag cleaning apparatus of claim 1, further comprising:

said housing having interior walls dividing said interior space into a manifold chamber, a tank chamber, and a pump chamber;

said pump being positioned in said pump chamber, said tank being positioned in said tank chamber and said influent and exfluent manifolds being substantially positioned in said manifold chamber.

5. The urine bag cleaning apparatus of claim 4, further comprising:

a cover member slidingly engaged to said housing for selectively covering said pump chamber and said tank chamber.

6. The urine bag cleaning apparatus of claim 4, further comprising:

a lid pivotally coupled to said housing for selectively covering said manifold chamber.

7. The urine bag cleaning apparatus of claim 1, further comprising:

said influent manifold and said exfluent manifold each having three selectively openable apertures for permitting cleansing of up to three urine bags simultaneously.

8. The urine bag cleaning apparatus of claim 1, further comprising:

an electrical cord operationally coupled to said pump whereby said pump is adapted for electrical connection to an electrical outlet to power said pump.

9. The urine bag cleaning apparatus of claim 1, wherein said filtering system further comprises:

a first filter and a second filter, said first filter being coupled to said exfluent manifold for filtering the fluid before it passes into said tank;

said second filter being coupled to said conduit for filtering the fluid before it passes into the pump.

10. The urine bag cleaning apparatus of claim 9, further comprising:

a detergent reservoir environmentally coupled to said conduit for introducing for mixing a cleanser with the fluid to facilitate cleansing and deodorizing of the urine bag;

said second filter being positioned between said tank and said detergent reservoir for filtering the fluid before the cleanser is mixed into the fluid.

11. A urine bag cleaning apparatus comprising:

a housing having an interior space;

a pump positioned in said interior space;

a tank positioned in said interior space;

a conduit positioned in said interior space and environmentally coupling said pump and said tank;

a filter system operationally coupled to said tank for filtering a fluid passed through said tank;

an influent manifold positioned in said interior space and environmentally coupled to said pump;

an exfluent manifold positioned in said interior space and environmentally coupled to said tank;

said influent manifold and said exfluent manifold having substantially aligned apertures whereby said influent and exfluent manifolds are adapted for coupling to opposite ends of a urine bag to form a closed system for passing the fluid through the urine bag whereby the urine bag is cleansed;

a drain operationally coupled to said tank for permitting draining of said tank when desired;

a detergent reservoir environmentally coupled to said conduit for introducing for mixing a cleanser with the fluid to facilitate cleansing and deodorizing of the urine bag;

said housing having interior walls dividing said interior space into a manifold chamber, a tank chamber, and a pump chamber;

said pump being positioned in said pump chamber, said tank being positioned in said tank chamber and said influent and exfluent manifolds being substantially positioned in said manifold chamber;

a cover member slidingly engaged to said housing for selectively covering said pump chamber and said tank chamber;

a lid pivotally coupled to said housing for selectively covering said manifold chamber;

said influent manifold and said exfluent manifold each having three selectively openable apertures for permitting cleansing of up to three urine bags simultaneously;

an electrical cord operationally coupled to said pump whereby said pump is adapted for electrical connection to an electrical outlet to power said pump; and wherein said filtering system includes a first filter and a second filter, said first filter being coupled to said exfluent manifold for filtering the fluid before it passes into said tank;

said second filter being coupled to said conduit for filtering the fluid before it passes into the pump; and said second filter being positioned between said tank and said detergent reservoir for filtering the fluid before the cleanser is mixed into the fluid.

* * * * *